US007190269B2

(12) United States Patent
Yang

(10) Patent No.: US 7,190,269 B2
(45) Date of Patent: Mar. 13, 2007

(54) FIBER OPTIC SECURITY SYSTEM AND CONTROL METHOD THEREOF

(76) Inventor: Kwan-suk Yang, 308-401 Shinan-poonglim A.P.T., 1235 Kwonsun-dong, Kwonsun-gu, Suwon-si, Gyunggi-do (KR) 441-834

( * ) Notice: Subject to any disclaimer, the term of this patent is extended or adjusted under 35 U.S.C. 154(b) by 173 days.

(21) Appl. No.: 10/525,617

(22) PCT Filed: Aug. 30, 2002

(86) PCT No.: PCT/KR02/01644

§ 371 (c)(1),
(2), (4) Date: Feb. 25, 2005

(87) PCT Pub. No.: WO2004/032080

PCT Pub. Date: Apr. 15, 2004

(65) Prior Publication Data

US 2006/0153489 A1 Jul. 13, 2006

(51) Int. Cl.
*G08B 13/18* (2006.01)

(52) U.S. Cl. ..... 340/555; 340/556; 362/511

(58) Field of Classification Search ..... 340/556
See application file for complete search history.

(56) References Cited

U.S. PATENT DOCUMENTS

| | | | | |
|---|---|---|---|---|
| 4,370,020 | A * | 1/1983 | Davey | 385/147 |
| 4,371,869 | A * | 2/1983 | Davidson | 340/557 |
| 4,379,289 | A * | 4/1983 | Peek | 340/555 |
| 4,399,430 | A * | 8/1983 | Kitchen | 340/550 |
| 4,538,527 | A * | 9/1985 | Kitchen | 109/21 |
| 5,592,149 | A * | 1/1997 | Alizi | 340/550 |
| 5,656,996 | A | 8/1997 | Houser | |
| 6,888,461 | B2 * | 5/2005 | Houde | 340/555 |
| 6,980,108 | B1 * | 12/2005 | Gebbia et al. | 340/555 |
| 2002/0130776 | A1 * | 9/2002 | Houde | 340/541 |

FOREIGN PATENT DOCUMENTS

| | | |
|---|---|---|
| KR | 1998-901 | 3/1998 |
| KR | 2001-34981 | 5/2001 |
| KR | 2001-67487 | 7/2001 |

* cited by examiner

*Primary Examiner*—Daniel Wu
*Assistant Examiner*—George Bugg
(74) *Attorney, Agent, or Firm*—Volpe and Koenig, PC

(57) ABSTRACT

The invention relates to a fiber optic security system and control method thereof which, in detail, is embodied by plural channels each comprising an optical transmitter module, an optical transmission line, and an optical receiver module. The invention is easy to install on windows, doors or fences which need to be secured and improves the degree of security by means of operating the plural channels at random sequence.

The present invention takes the effect that the invention makes it possible to cope flexibly with the actual spot to be installed by connecting plural channels each comprising an optical transmitter module, an optical transmission line, and an optical receiver module in order to cope with the dimension of the actual spot to be installed, and by cutting the plastic optical fibers in order to cope with the length of the actual spot to be installed, to maintain conveniently due to the ability of replacing channels one by one, and to reduce maintenance expenses.

Besides, the present invention can make it possible to be seen through and to obtain fine appearance because of using the plastic optical fibers, and to prevent hackings and to improve the degree of security because of checking detection signals non-sequentially.

15 Claims, 7 Drawing Sheets

FIBER OPTIC SECURITY SYSTEM AND CONTROL METHOD THEREOF

FIELD OF THE INVENTION

The present invention relates to a fiber optic security system and control method thereof, and more particularly, to a fiber optic security system and control method thereof comprising a plurality of channel constituted an optical transmitter module, an optical transmission line, and an optical receiver module. The security system can be easily set on a window, doors or fences without doing harms to them. Also The security system improves security level by operating the channels randomly.

BACKGROUND

A fiber optic security system monitors an area which the system installed, and discerns whether any intrusion or attempt to intrude is or not. It is installed on such facilities as an armed force, airports, power plants, detention houses etc. to protect the facilities from possible intruders. It can reduce the number of guards and has the advantage of providing a substitutive means of communication using the optical fibers installed.

There are some methods of using optical fibers as a sensor; method for measuring dynamic variation of optical signals by using the optical speckle, method for measuring static variation of the strength of optical signals due to optical losses, and method for measuring physical fluctuation of optical fibers by using the back scattering of optical signals.

A security system using the optical speckle to detect an intruder discerns whether there is any intrusion by cutting off some part of optical signals at an end of the optical fibers and measuring the strength of the optical signals passed. Because there occur multipath interferences caused by changes of environment in an optic fiber during the transfer of the optical signals through the optical fiber, wherein the optical signals are transferred in the form of continuous waves.

And there is a method of using the back scattering of optical signals generated at the optical fibers during the transfer of optical signals through the optical fibers. This method discerns whether there is any intrusion by detecting the strength of returning optical signals which are back-scattered at transferring media transferring in the form of pulses. This method is able to detect even the location where the physical fluctuation occurs at the optical fiber.

FIG. 7 and FIG. 8 are illustrative diagrams of fiber optic security systems disclosed as US and EP patents; FIG. 7 is disclosed in U.S. Pat. No. 5,592,149 of Uri Alizi and FIG. 8 is disclosed in european patent No. 0,049,979 of Pilkington P. E. Ltd.

As shown in the figures, the security systems each comprises a support(120) set up at the place where need to be secured in a predetermined shape, a net of optical fibers(130) fixed to said support(120), a transmitter controller(100) transmitting predetermined optical signals to said net of optical fibers(130), and a receiver controller(110) discerning whether intruded or not by analyzing the optical signals received from said net of optical fibers(130).

Said net of optical fibers(130) is in the form of interlooped optical wire structure formed by simply crossing and twisting a strand of the optical fiber.

The security system having the above constitution detects a signal of external intrusion while said transmitter controller(100) transmits optical signals to said net of optical fibers(130) and said receiver controller receives the optical signals passed through said net of optical fibers(130).

Namely the security system, when someone cuts or stretch said net of optical fibers(130), detects change of optical signals.

The security system having said net of optical fiber is not cost-effective to construct and convenient to install because said net of optical fiber should be weaved at places installed one by one to meets the size of the area to be protected. Furthermore, the security system has the problem of high expense of maintenance because said net of optical fiber should be replaced entirely when it is cut off.

In addition, the security system has the problem of malfunction caused by the fact that it can not discriminate between the change of the optical signals on account of attempt to intrude and the change of the optical signals on account of natural phenomena such as rain, wind, or vibration taken place in neighborhood.

The present invention is conceived to solve the problems of the conventional fiber optic security system. Accordingly, it is an object of the present invention to provide a fiber optic security system being simple and easy to install regardless of the size of the area to be protected, and convenient to maintain and a control method thereof.

Another object of the present invention is to provide a fiber optic security system having transparent fibers to be seen outer scenery through when installed, having a fine appearance, reducing false alarms caused by external environmental change such as rain, vibration or the wind, and improving reliability of the system by means of preventing hackings and a control method thereof.

SUMMARY

The fiber optic security system of the present invention comprises a plurality of optical transmitter module for outputting an optical signal; a plurality of optical transmission line for transmitting the optical signal an end of which connected respectively to said optical transmitter modules; a plurality of optical receiver module for detecting the optical signal connected respectively to the opposite end of said optical transmission lines; and a controller for controlling said optical transmitter modules and said optical receiver modules, discriminating the state of said optical transmission lines respectively by a status signal of the optical signal received from said optical receiver modules; wherein, each of the optical transmitter modules comprises a first connector for receiving signals from said controller which can be connected to a transmitting connector of said controller; a second connector which can be connected to the first connector of a neighboring optical transmitter module; and an optical transmitter which outputs an optical signal according to a control signal from said controller; each of the optical receiver modules comprises a first connector for receiving signals from said controller which can be connected to a receiving connector of said controller; a second connector which can be connected to the first connector of a neighboring optical receiver module; and an optical receiver for receiving an optical signal from the optical transmission line; one of said optical transmitter modules is connected to the transmitting connector of said controller and the others are connected one after another, one of said optical receiver modules is connected to the receiving connector of said controller and the others are connected one after another, said controller provides a data signal and an operation signal to a predetermined optical transmitter module, wherein the data signal is for operating the predetermined optical transmitter module and the operation signal is for operating the optical transmitter of the predetermined optical transmitter module, simultaneously provides the same data signal to an optical receiver module corresponding to the predetermined optical transmitter module and receives a detection signal from the optical receiver module, wherein the same data signal is for controlling the optical receiver module and the detection signal include an information whether the optical receiver module received optical signal from the predetermined optical transmitter module, each of said optical transmitter modules and said optical receiver modules respectively transmits the data signal received from said controller to neighboring optical transmitter module and neighboring optical receiver module in sequence.

Also, the fiber optic security system of the present invention, further comprises an indicator displaying the status of intrusion in case of receiving an alarm signal from said controller and an external terminal for providing the alarm signal to external device.

Moreover, the fiber optic security system of the present invention is characterized in that, it further comprises a pair of feedback connectors connected respectively to the second connector of the last optical transmitter module and the last optical receiver module in order to feed the data signal from said controller back to said controller.

Also, the fiber optic security system according to the present invention is characterized in that, it further comprises an indicator displaying the status of intrusion on receiving an alarm signal transmitted from said controller in case of not receiving the feedback data signal and an external terminal for providing the alarm signal to external device.

Furthermore, the fiber optic security system according to the present invention is characterized in that, it further comprises an optical transmitter module case, being a hollow cylinder in shape, holding said optical transmitter modules inside, having a plurality of through hole for allowing the optical transmission lines connected respectively to the optical transmitter modules; an optical receiver module case, being a hollow cylinder in shape, holding said optical receiver modules inside, having a plurality of through hole for allowing the optical transmission lines connected respectively to the optical receiver modules; a couple of magnetic body respectively forming prescribed magnetic fields outside of said optical transmitter module case and said optical receiver module case; and a couple of magnetic sensor respectively placed inside of said optical transmitter module case and said optical receiver module case facing said magnetic bodies, detecting change of position of said optical transmitter module case and said optical receiver module case, outputting a signal regarding change of position to said controller.

Besides, the fiber optic security system according to the present invention is characterized in that said optical transmission line is selected from the group consisting of a plastic optical fiber, an optical waveguide, and air.

Also, the fiber optic security system according to the present invention is characterized in that said plastic optical fiber is coated with permeation preventer including urethane acrylate in order to prevent external disturbing rays from permeating and protect the surface of said plastic optical fiber.

On the other hand, a method for controlling a fiber optic security system of the present invention comprising a plurality of optical transmitter module for outputting an optical signal, a plurality of optical transmission line for transmitting the optical signal an end of which connected respectively to said optical transmitter modules, a plurality of optical receiver module for detecting the optical signal connected respectively to the opposite end of said optical transmission lines, a pair of feedback connector, a pair of feedback connectors connected respectively to the last optical transmitter module and the last optical receiver module, and a controller for controlling said optical transmitter modules and said optical receiver modules, discriminating the state of said optical transmission lines respectively by a status signal of the optical signal received from said optical receiver modules, wherein each optical transmitter module and optical transmission line and optical receiver module forms channel, comprising the steps of: checking status of each channel by transmitting data signals and operation signals to each channel and receiving detection signals in said controller; storing the number of channels if all the channels are normal, otherwise outputting error signal in said controller; generating randomly a channel-operation-sequence by a program stored in said controller; operating a channel according to the channel-operation-sequence by transmitting a data signal and an operation signal to the channel in said controller; verifying the status of security by outputting warning signal if detection signal is not inputted, otherwise operating next channel according to the channel-operation-sequence in said controller; regenerating randomly a new channel-operation-sequence in case of receiving detection signal from last channel according to the channel-operation-sequence in said controller.

Also the method for controlling a fiber optic security system of the present invention further comprises the step of initializing the fiber optic security system in said controller by transmitting data signals to said optical transmitter modules and said optical receiver modules, transmitting operation signals for operating said optical transmitter modules at the same time, receiving detection signals of optical signals from said optical receiver modules, storing the number of channels which transmit detection signals.

Figure 1:
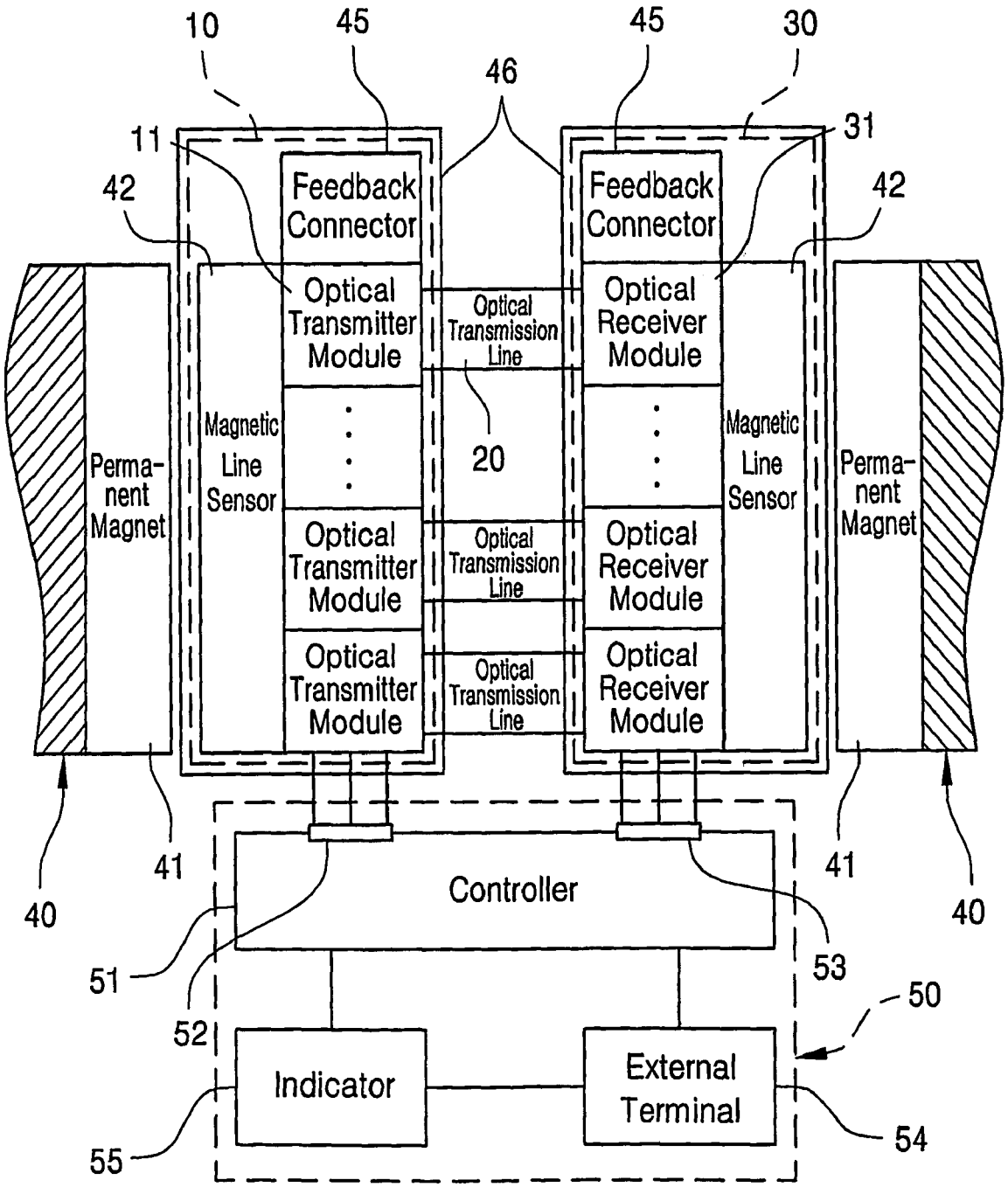
FIG. 1 is a block diagram of an embodiment of a fiber optic security system in accordance with the present invention.

<Explanation of reference numerals for designating main components in the drawings>

| | | | |
|---|---|---|---|
| 10 | optical transmitter part | 11 | optical transmitter module |
| 12, 32 | first connector | 13 | optical transmitter |
| 14, 34 | second connector | 20 | optical transmission line |
| 30 | optical receiver part | 31 | optical receiver module |
| 33 | optical receiver | 40 | wall |
| 41 | permanent magnet | 42 | magnetic sensor |
| 45 | feedback connector | 46 | module case |
| 50 | control box | 51 | controller |
| 52 | transmitter connector | 53 | receiver connector |
| 54 | external terminal | 55 | indicator |
| 61 | data input signal | 62 | data output signal |
| 63 | detection signal | 64 | sensor signal |
| 100 | output controller | 110 | input controller |
| 120 | support | 130 | net of optical fibers |

DETAILED DESCRIPTION OF THE PREFERRED EMBODIMENTS

Preferred embodiments of the present invention will be described in detail with reference to the accompanying drawings.

Figure 2A:
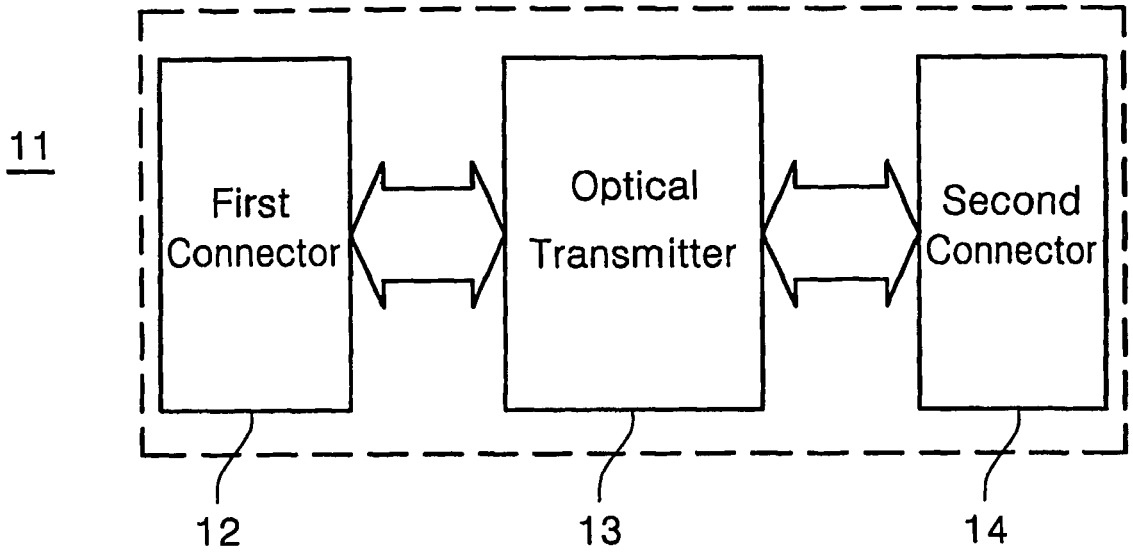
FIG. 2*a* is a block diagram of an embodiment of an optical transmitter module in accordance with the present invention.
Figure 2B:
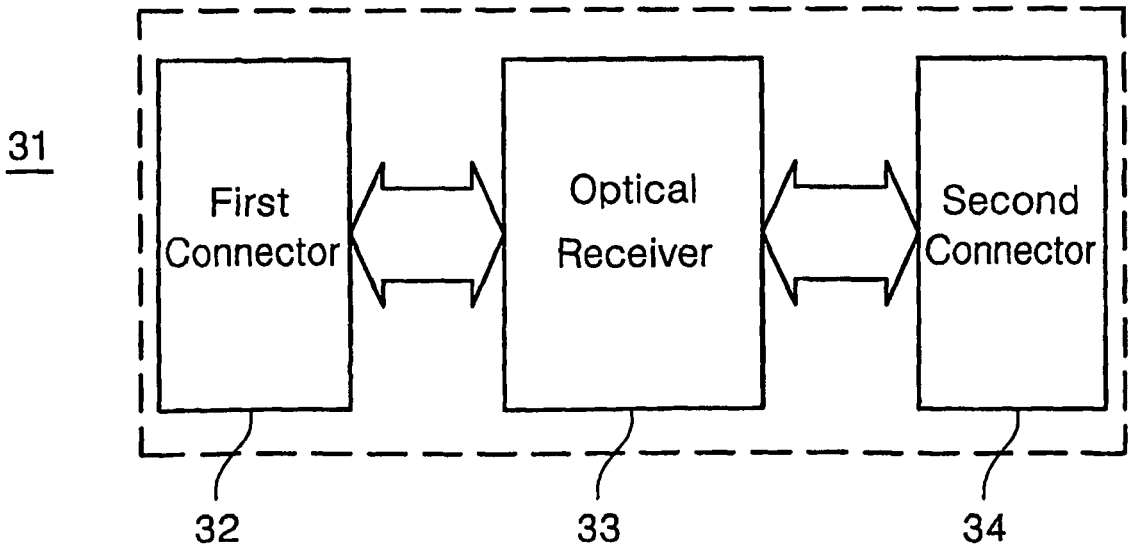
FIG. 2*b* is a block diagram of an embodiment of an optical receiver module in accordance with the present invention.
Figure 3:
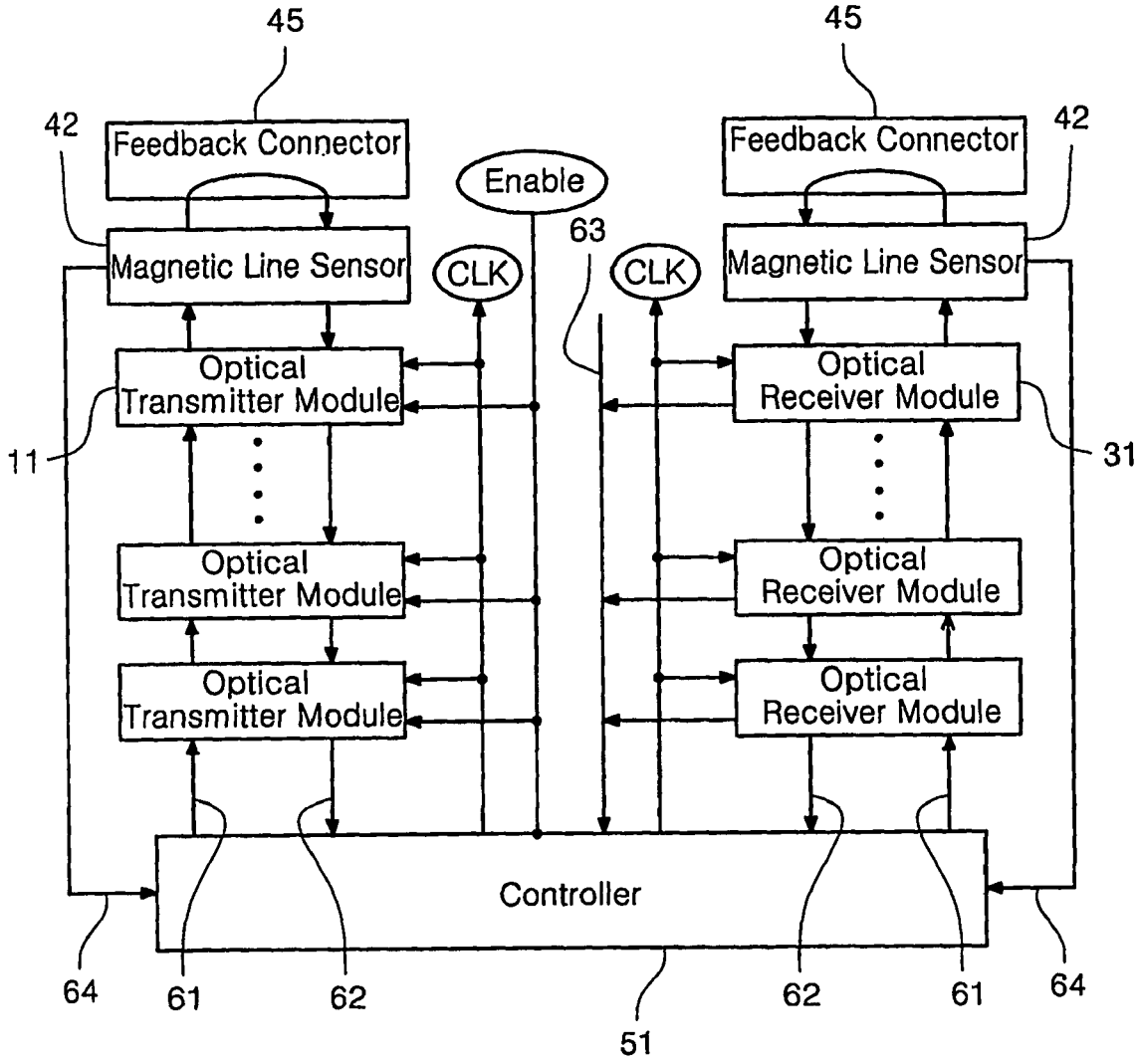
FIG. 3 is a control circuit diagram of an embodiment of a fiber optic security system in accordance with the present invention.
Figure 4A:
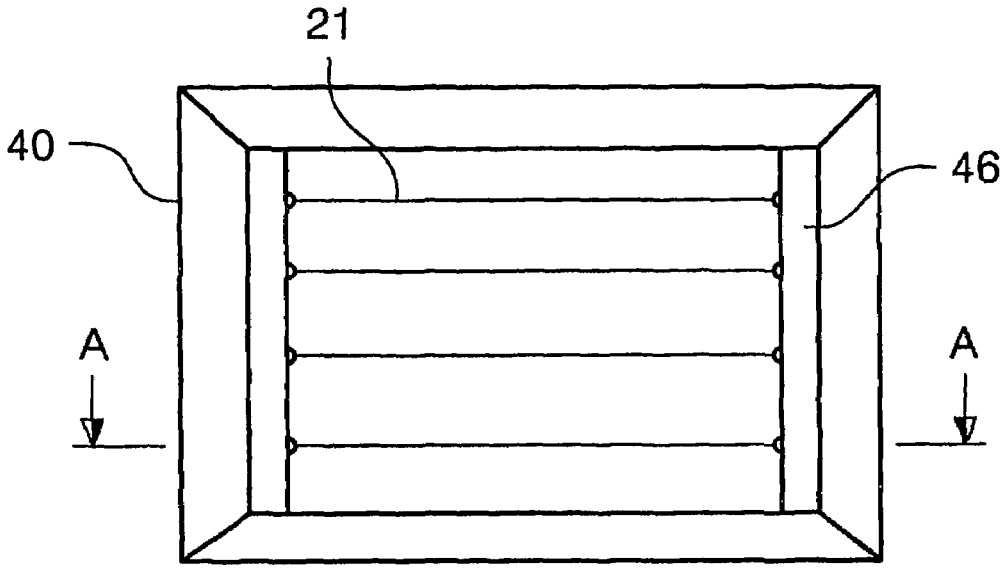
FIG. 4*a* is a front view of a fiber optic security system installed on a window frame in accordance with the present invention.
Figure 4B:
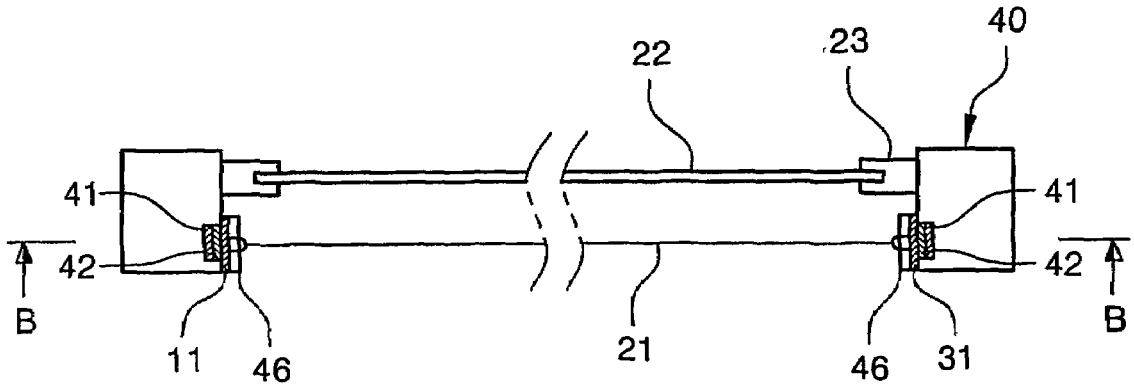
FIG. 4*b* is a cross section according to the A—A line shown in FIG. 4*a*.
Figure 4C:
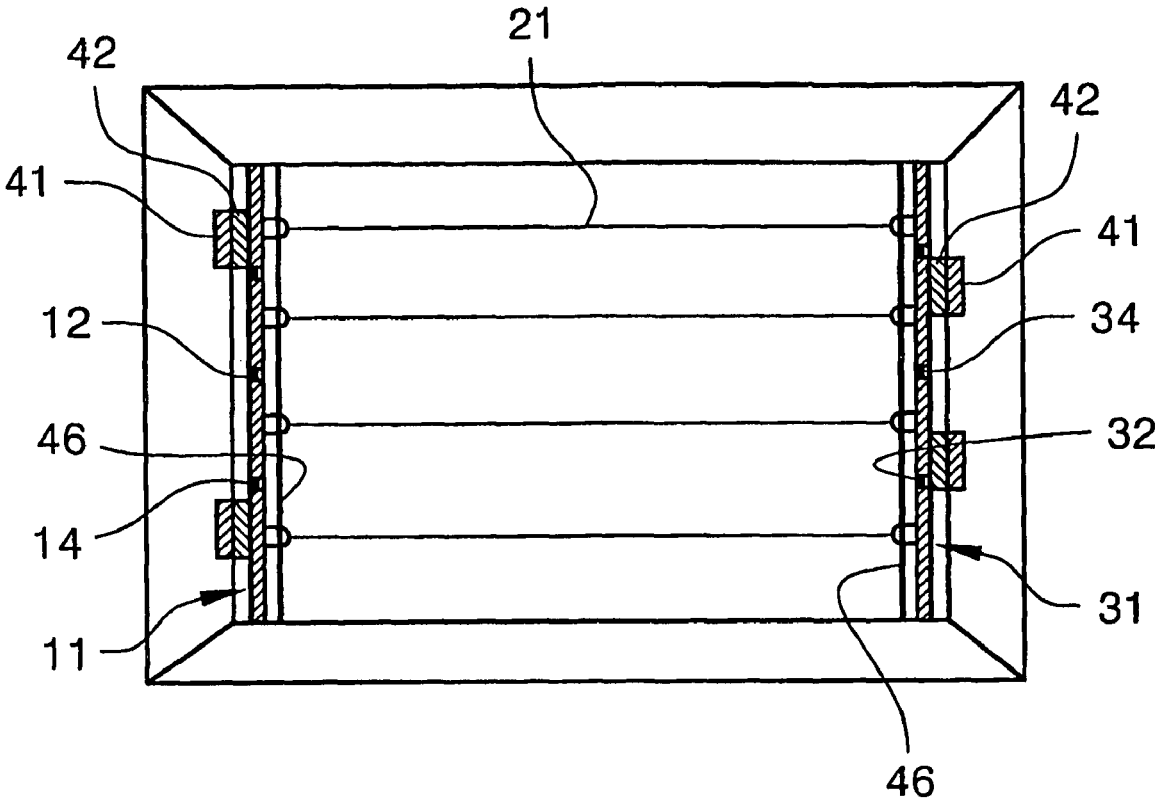
FIG. 4*c* is a cross section according to the B—B line shown in FIG. 4*a*.
Figure 5:
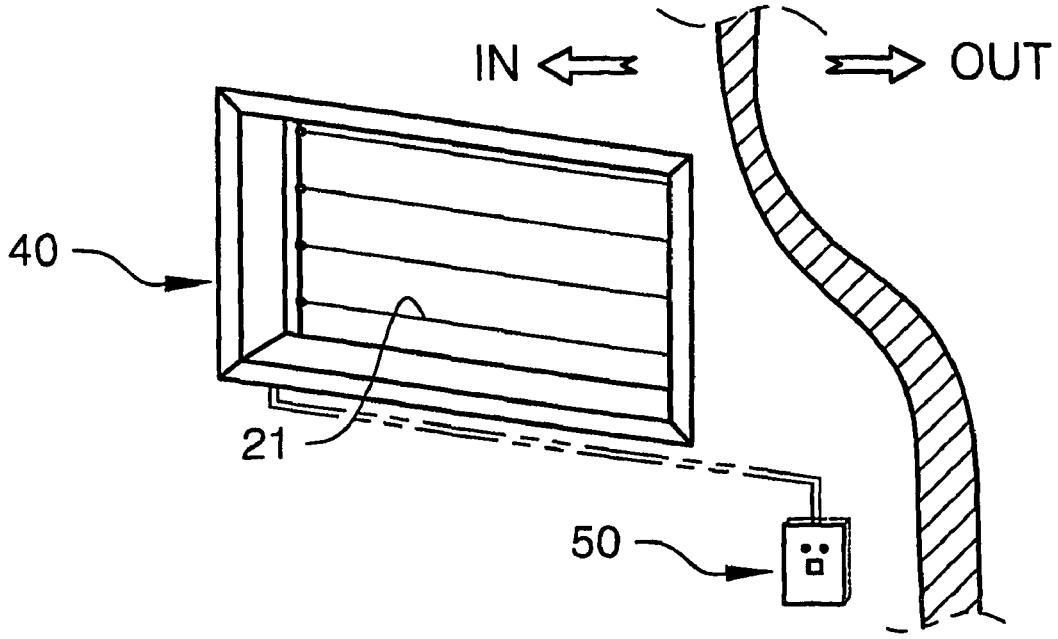
FIG. 5 is a illustrative diagram of a fiber optic security system installed on a window in accordance with the present invention.
Figure 6:
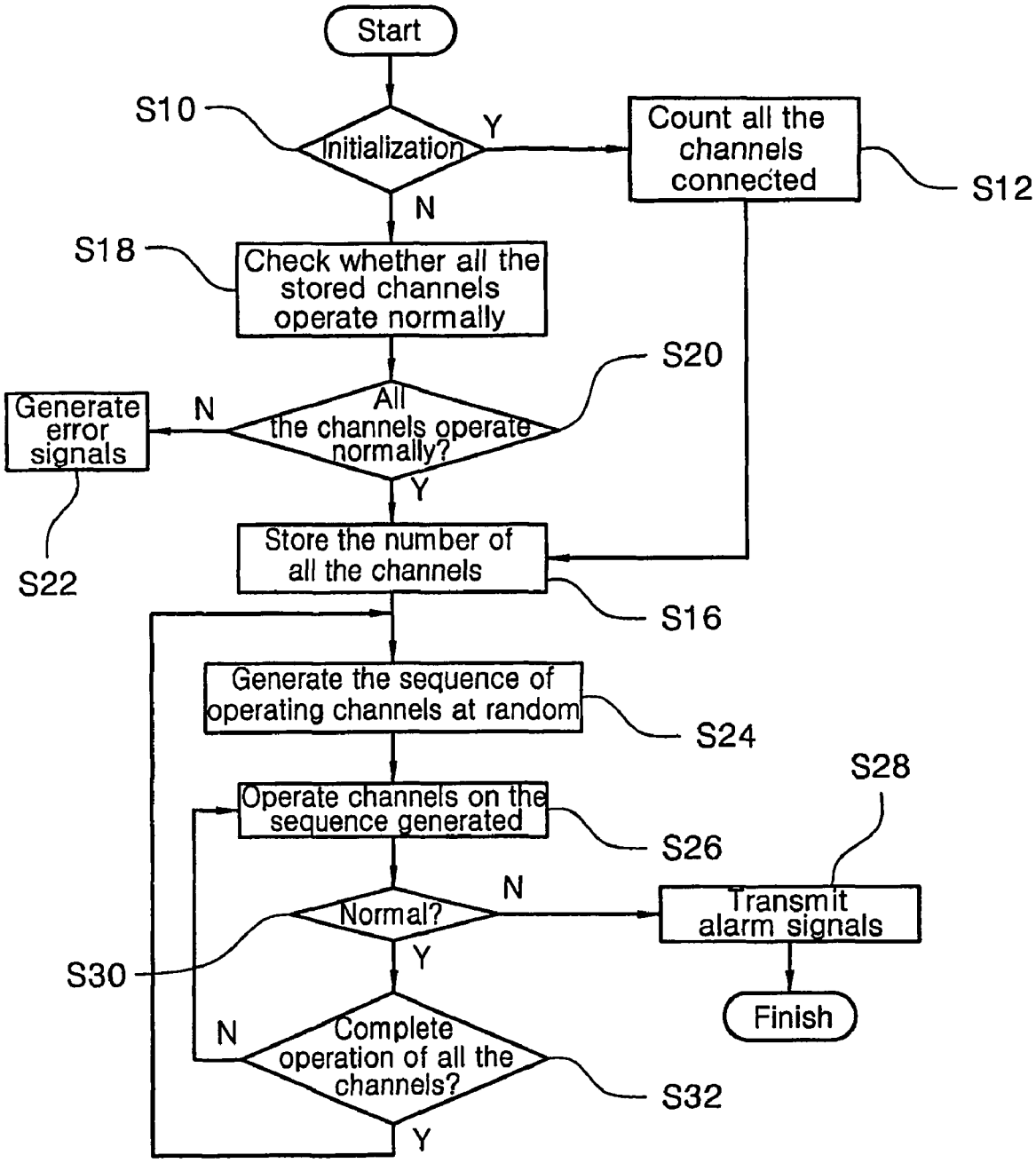
FIG. 6 is a flowchart showing a flow of operation of a fiber optic security system in accordance with the present invention.
Figure 7:
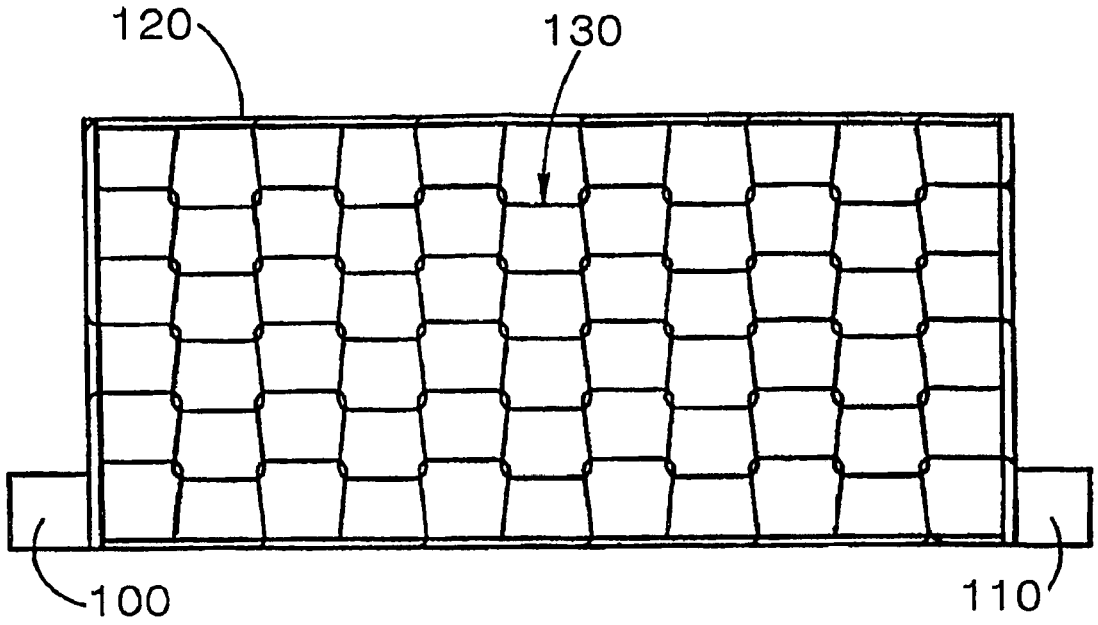
FIG. 7 and FIG. 8 are illustrative diagrams of conventional fiber optic security systems.
Figure 8:
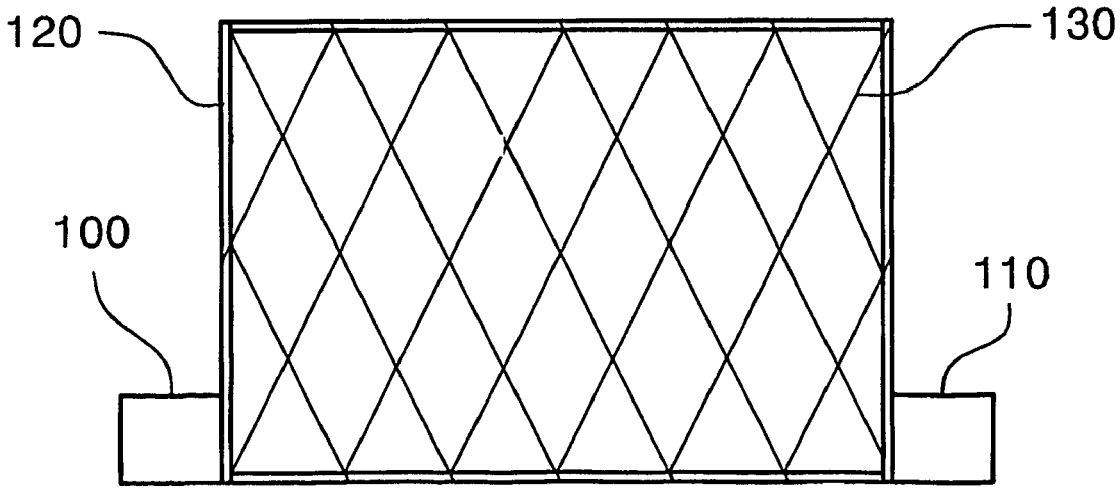

FIG. 1 is a block diagram of an embodiment of a fiber optic security system in accordance with the present invention, FIG. 2*a* is a block diagram of an embodiment of an optical transmitter module in accordance with the present invention, FIG. 2*b* is a block diagram of an embodiment of an optical receiver module in accordance with the present invention, FIG. 3 is a control circuit diagram of an embodiment of a fiber optic security system in accordance with the present invention, FIG. 4*a* is a front view of a fiber optic security system installed on a window frame in accordance with the present invention, FIG. 4*b* is a cross section according to the A—A line shown in FIG. 4*a*, FIG. 4*c* is a cross section according to the B—B line shown in FIG. 4*b*, FIG. 5 is a illustrative diagram of a fiber optic security system installed on a window in accordance with the present invention, and FIG. 6 is a flowchart showing a flow of operation of a fiber optic security system installed on a window frame in accordance with the present invention.

As shown in FIG. 1, the present invention comprises an optical transmitter part(10) outputting optical signals, optical transmission lines(20) transferring the optical signals outputed from said optical transmitter part(10), optical receiver part(30) receiving the optical signals through said optical transmission lines(20), and a control box(50) controlling said optical transmitter part(10) and said optical receiver part(230) and discerning whether there is any intrusion or not.

Said optical transmitter part(10) comprises plural optical transmitter modules(11) and a feedback connector(45) connected in series, and said optical receiver part(30) comprises plural optical receiver modules(31) and a feedback connector(45) connected in series. Besides, each of said optical transmitter part(10) and optical receiver part(30) is installed inside module cases(46) respectively.

Said module cases(46) are a hollow cylinder in shape which can accommodates respectively said optical transmitter modules(11) and optical receiver modules(31) inside, and at one side of which plural holes are bored to connect said optical transmission lines to said optical transmitter and optical receiver modules through.

Said optical transmitter modules(11), said optical transmission lines(20), and said optical receiver modules(31) forms one channel detecting intrusion from outside.

Moreover, magnetic bodies, preferably permanent magnets(41), are installed on inside of the wall(40) of security area, and magnetic sensors(42) are installed on inside of said module cases(46) to correspond to said permanent magnet (41) so as to detect the displacement of said module case (46).

Said control box(50) comprises a controller(51) controlling said optical transmitter part(10) and optical receiver part(30), and discerning whether there is any intrusion, an indicator(55) which enables to discern the status of intrusion visually and easily on receiving alarm signals from said controller(51), and an external terminal(54) through which the alarm signals of said controller(51) can be delivered to an outer devices.

Said controller(51) comprises a transmitter connector(52) in order to control optical transmitter modules of said optical transmitter part(10), and a receiver connector(53) in order to control optical receiver modules of said optical receiver part(30). And said indicator(55) comprises light emitting elements which emit light by alarm signals. Said light emitting elements are of already known technical element, therefore light emitting diodes(LED), bulbs and others can be used as said light emitting elements.

Any one selected among microprocessors of 8 bits, 16 bits and 32 bits can be used as said controller(51) while the selection depends on the number of said optical transmitter modules and optical receiver modules.

Said microprocessor controls the processing of optical signals such as driving said optical transmitter modules(11), receiving signals from said optical receiver modules(31), and discerning whether there is any intrusion. Also, in order to prevent hackings, the operation of driving said optical transmitter modules and optical receiver modules executed by way of frequency modulation or frequency and pulse width modulation.

Said optical transmitter module(11), as seen in FIG. 2*a*, comprises a first connector(12) receiving the control signals from said controller, an optical transmitter(13) transmitting optical signals converted from electric signals received, and a second connector(14) in order to connect to an optical transmitter module neighboring.

Said optical receiver module(31), as seen in FIG. 2*b*, comprises a first connector(34) receiving the optical signals from said optical transmitter module(11) and transmitting electric signals converted from the optical signals, an optical receiver(33) converting the optical signals received from said optical transmitter module(11) to electric signals, and a second connector(14) in order to connect to an optical receiver module neighboring.

Therefore, in order to connect plural channels respectively comprising said optical transmitter module(11), optical transmission line(20), and optical receiver module(31), the second connector(14) of said optical transmitter module (11) is connected to the first connector(12) of an optical transmitter module(11) of neighboring channel, and the second connector(34) of said optical receiver module(31) is connected to the first connector(32) of an optical receiver module(31) of neighboring channel. It is evident that each set of said optical transmitter module(11) and optical receiver module(31) is connected with an optical transmission line(20) to form a channel.

The first connector(12) of the first one among said plural optical transmitter modules(11) is connected to the transmitter connector(52) of said controller(51), and the second connector(12) of the last one among said plural optical transmitter modules(11) is connected to the feedback connector(45) to feed signals of said controller(51) back. In the same manner, the first connector(31) of the first one among said plural optical receiver modules(31) is connected to the receiver connector(53) of said controller(51), and the second connector(12) of the last one among said plural optical receiver modules(11) is connected to the feedback connector (45) to feed signals of said controller(51) back.

Said optical transmission line(20) can be selected from such things as an optical waveguide, an optical fiber, and air which could transmit light through.

When said optical transmitter line(20) selected is an optical waveguide or an optical fiber, said optical transmitter (13) and optical receiver(33) need to be connected optically at connection portions. Especially, when the medium of the optical waveguide is air, said optical transmitter(13) and optical receiver(33) should be made so that they can transmit or receive light signals. As such techniques are already known to the public, anyone skilled in the relevant art can easily carry out.

However, it is desirable to use an optical fibers, more desirable to use to use an plastic optical fiber cables than an optical fiber cables of the quartz.

It is preferred that the plastic optical fiber has the optical loss of 0.2 dB/m in the wavelength of 650 nm, and more preferable it has the diameter of 0.5 to 1.0 mm considering flexibility and fine appearance. And in order to prevent external disturbing rays from penetrating and protect the surface of the plastic optical fiber, it is coated outside with permeation preventer. The permeation preventer, including urethane acrylate which is a kind of ultraviolet curable resins, prevents ultraviolet and infrared rays from permeating and cuts off noises caused by interfering rays having the wavelength beyond that of the optical signals. Also, dyes of various colors can be added to the permeation preventer so that the color of the plastic optical fiber can be finer. Namely, by using infrared rays as optical signals and permeating visible rays through, the optical fiber can get good appearance and visibility. It is desirable that the thickness of the coating is in the range of 0.75 to 1.5 mm considering flexibility and fine appearance.

FIG. 3 is a control circuit diagram of an embodiment of a fiber optic security system in accordance with the present invention. With reference to FIG. 3, at first, said controller (51) transmits data signal to an optical transmitter module (11) through data input signals(61) for selecting a predetermined optical transmitter module(11) of said optical transmitter part(10), and outputs operation signal(enable signal line) and clock signal(CLK line) by dividing clock frequency. Said data signal, operation signal, and clock signal are transmitted from the transmitter connector(52) of the controller(51) to a predetermined optical transmitter module(11), at the same time said data signal are transmitted to an optical receiver module(31) corresponding to the predetermined optical transmitter module(11) as an enable signal to operate the optical receiver module(31).

The predetermined optical transmitter module(11), being received the data input signals(61), converts electric signals to optical signals through said optical transmitter(13) and outputs the optical signals so as to transmit the optical signals on receiving the operation signal while standing by ready for operating the optical transmitter(13).

And the predetermined optical receiver module(31), being received said data input signals(61), is ready for operating the optical receiver(33).

Said optical signal are transferred to the optical receiver (33) of said specific optical receiver module(31) through the optical transmission line(20), and the optical signal transmitted is converted to electric signals and transferred to said controller(51) as detection signals(63).

Then, discernment whether there is intrusion is executed according to said detection signals(63) in controller(51). Also, sensor signal(64) detects whether there is any damage on the optical transmitter part(10) and the optical receiver part(30) by the signals from said magnetic sensor(42). So to speak, when said module case(46) drifts from the permanent magnet(41) installed on the wall(40) to be secured, said magnetic sensor(42) perceives the variation of magnetic force caused by said permanent magnet(41) and transmits said sensor signals(64) to said controller(51).

Besides, said optical transmitter part(10) and optical receiver part(30) detect the damage of any optical transmitter module or optical receiver module and transmit the result thereof to said controller.

That is to say, said optical transmitter module(11) and optical receiver module(31) receive the data signals of said controller(51) through the first connector(12) and shift them to the second connector(14), which are fed back to said controller(51) by the feedback connector(54) connected to the second connector(14) of the last stage. Therefore, when any one of the optical transmitter modules(11) and optical receiver modules(31) is damaged, because said data signals are not fed back to said controller(51) the damage to said optical transmitter part(10) or optical receiver part(30) by an attempt to intrude can be detected.

At this point, in order to operate said specific optical transmitter module and correspondent optical receiver module, anyone skilled in the relevant art knows that coding and transmitting said data signals and the operation signals (Enable) can generate various control signals, and can carry out thereof.

FIG. 4*a* to FIG. 5 are for the embodiment of the present invention installed on a window; plural channels are formed on the glass(22) of the wall(security wall; 40) of a window frame and outside(OUT) of the window frame and the control box(50) is installed inside(IN) of the security wall (40).

While the dimension of the window frame can vary, the module cases(46) holding said optical transmitter part(10) and optical receiver part(30) can be attached to both side of the window frame and said optical transmitter module(11) can be connected to said optical receiver module(31) through the plastic optical fibers(21) cut into the length of the window frame. Moreover, as occasion demands, said optical transmitter module(11) and optical receiver module (31) can be connected successively according to the dimension of the window frame.

The present invention installed on the window frame does not go inside the bound bounded by that, and anyone skilled in the relevant art can easily know that the invention can be installed on various places in need of securing such as a fence and so on and can carry out thereof.

To describe the operation and the effect of the present invention, as seen in FIG. 3 and FIG. 6, it is checked whether the number of channels comprising said optical transmitter module(11), optical transmission line(20), and optical receiver module(31) is memorized.

So to speak, the initialization is executed when the number of channels is not memorized(S10).

Said initialization transmits data signals to said optical transmitter module(11) and optical receiver module(31) and operation signals(Enable) operating said optical transmitter module(11), counts all the channels connected by means of receiving detection signals(63) of optical signals of said optical receiver module(31) replied to the operation signals, and stores the counted number of channels in said controller (51)(S16).

However, when the number of channels is stored in said controller(51) because said initialization has already been executed, said controller(51) transmits the data signals and the operation signals to all the channels stored and checks whether the operation of said channels is normal by means of receiving detection signals replied to the data signals and the operation signals(S18).

At this point, when said all the channels do not operate normally, said controller(51) generates error signals(S22) and transmits alarm signals to the indicator(55) and the external terminal(54) in FIG. 1.

Otherwise, when said all the channels operate normally (S20), the number of channels is stored just as in said step S16, then the program stored in said controller(51) generates the sequence of operating said stored channels at random. Said random sequence generating program can be one of the programs known to the public, and so detailed description may be omitted.

After that, said controller operates each channel by means of transmitting data signals and operation signals to the specific channel on said sequence generated, transmits alarm signals perceiving intrusion when normal detection signals (63) are not inputted(S28), and operates the next channel when normal detection signals are inputted.

On receipt of detection signals(63) from the last channel on said sequence generated, said controller re-generates said sequence of operation and re-operate the specific channel on the sequence re-generated(S32).

INDUSTRIAL APPLICABILITY

As the above statement, the present invention takes the effect that the invention makes it possible to cope flexibly with the actual spot to be installed by connecting plural channels each comprising an optical transmitter module, an optical transmission line, and an optical receiver module in order to cope with the dimension of the actual spot to be installed, and by cutting the plastic optical fibers in order to cope with the length of the actual spot to be installed, to maintain conveniently due to the ability of replacing channels one by one, and to reduce maintenance expenses.

Besides, the present invention can make it possible to be seen through and to obtain fine appearance because of using the plastic optical fibers, and to prevent hackings and to improve the degree of security because of checking detection signals non-sequentially.

The embodiment of the present invention described above and illustrated in the drawings should not be construed as defining the technical spirit of the present invention. The scope of the invention is defined only by the appended claims and those skilled in the art can make various modifications and changes within the technical sprit of the invention. Therefore, such modifications and changes fall within the scope of the invention so long as they are obvious to those skilled in the art.

What is claimed is:

1. A fiber optic security system comprising:

a plurality of optical transmitter module for outputting an optical signal;

a plurality of optical transmission line for transmitting the optical signal an end of which connected respectively to said optical transmitter modules;

a plurality of optical receiver module for detecting the optical signal connected respectively to the opposite end of said optical transmission lines;

and a controller for controlling said optical transmitter modules and said optical receiver modules, discriminating the state of said optical transmission lines respectively by a status signal of the optical signal received from said optical receiver modules; wherein, each of the optical transmitter modules comprises a first connector for receiving signals from said controller which can be connected to a transmitting connector of said controller; a second connector which can be connected to the first connector of a neighboring optical transmitter module; and an optical transmitter which outputs an optical signal according to a control signal from said controller;

each of the optical receiver modules comprises a first connector for receiving signals from said controller which can be connected to a receiving connector of said controller; a second connector which can be connected to the first connector of a neighboring optical receiver module; and an optical receiver for receiving an optical signal from the optical transmission line;

one of said optical transmitter modules is connected to the transmitting connector of said controller and the others are connected one after another, one of said optical receiver modules is connected to the receiving connector of said controller and the others are connected one after another, said controller provides a data signal and an operation signal to a predetermined optical transmitter module, wherein the data signal is for operating the predetermined optical transmitter module and the operation signal is for operating the optical transmitter of the predetermined optical transmitter module, simultaneously provides the same data signal to an optical receiver module corresponding to the predetermined optical transmitter module and receives a detection signal from the optical receiver module, wherein the same data signal is for controlling the optical receiver module and the detection signal include an information whether the optical receiver module received optical signal from the predetermined optical transmitter module, each of said optical transmitter modules and said optical receiver modules respectively transmits the data signal received from said controller to neighboring optical transmitter module and neighboring optical receiver module in sequence.

2. A fiber optic security system as claimed in claim 1, further comprising an indicator displaying the status of intrusion in case of receiving an alarm signal from said controller and an external terminal for providing the alarm signal to external device.

3. A fiber optic security system as claimed in claim 1, further comprising a pair of feedback connectors connected respectively to the second connector of the last optical transmitter module and the last optical receiver module in order to feed the data signal from said controller back to said controller.

4. A fiber optic security system as claimed in claim 3, further comprising an indicator displaying the status of intrusion on receiving an alarm signal transmitted from said controller in case of not receiving the feedback data signal and an external terminal for providing the alarm signal to external device.

5. A fiber optic security system as claimed in claim 1, further comprising, an optical transmitter module case, being a hollow cylinder in shape, holding said optical transmitter modules inside, having a plurality of through hole for allowing the optical transmission lines connected respectively to the optical transmitter modules;

an optical receiver module case, being a hollow cylinder in shape, holding said optical receiver modules inside, having a plurality of through hole for allowing the optical transmission lines connected respectively to the optical receiver modules;

a couple of magnetic body respectively forming prescribed magnetic fields outside of said optical transmitter module case and said optical receiver module case; and a couple of magnetic sensor respectively placed inside of said optical transmitter module case and said optical receiver module case facing said magnetic bodies, detecting change of position of said optical transmitter module case and said optical receiver module case, outputting a signal regarding change of position to said controller.

6. A fiber optic security system as claimed in claim 1, wherein said optical transmission line is selected from the group consisting of a plastic optical fiber, an optical waveguide, and air.

7. A fiber optic security system as claimed in claim 6, wherein said plastic optical fiber is coated with permeation preventer including urethane acrylate in order to prevent external disturbing rays from permeating and protect the surface of said plastic optical fiber.

8. A method for controlling a fiber optic security system comprising a plurality of optical transmitter module for outputting an optical signal, a plurality of optical transmission line for transmitting the optical signal an end of which connected respectively to said optical transmitter modules, a plurality of optical receiver module for detecting the optical signal connected respectively to the opposite end of said optical transmission lines, a pair of feedback connector, a pair of feedback connectors connected respectively to the last optical transmitter module and the last optical receiver module, and a controller for controlling said optical transmitter modules and said optical receiver modules, discriminating the state of said optical transmission lines respectively by a status signal of the optical signal received from said optical receiver modules, wherein each optical transmitter module and optical transmission line and optical receiver module forms channel, comprising the steps of:

checking status of each channel by transmitting data signals and operation signals to each channel and receiving detection signals in said controller;

storing the number of channels if all the channels are normal, otherwise outputting error signal in said controller;

generating randomly a channel-operation-sequence by a program stored in said controller;

operating a channel according to the channel-operation-sequence by transmitting a data signal and an operation signal to the channel in said controller;

verifying the status of security by outputting warning signal if detection signal is not inputted, otherwise operating next channel according to the channel-operation-sequence in said controller;

regenerating randomly a new channel-operation-sequence in case of receiving detection signal from last channel according to the channel-operation-sequence in said controller.

9. A method for controlling a fiber optic security system as claimed in claim 8, further comprising the step of initializing the fiber optic security system in said controller by transmitting data signals to said optical transmitter modules and said optical receiver modules, transmitting operation signals for operating said optical transmitter modules at the same time, receiving detection signals of optical signals from said optical receiver modules, storing the number of channels which transmit detection signals.

10. A fiber optic security system as claimed in claim 2, further comprising, an optical transmitter module case, being a hollow cylinder in shape, holding said optical transmitter modules inside, having a plurality of through hole for allowing the optical transmission lines connected respectively to the optical transmitter modules;

an optical receiver module case, being a hollow cylinder in shape, holding said optical receiver modules inside, having a plurality of through hole for allowing the optical transmission lines connected respectively to the optical receiver modules;

a couple of magnetic body respectively forming prescribed magnetic fields outside of said optical transmitter module case and said optical receiver module case; and a couple of magnetic sensor respectively placed inside of said optical transmitter module case and said optical receiver module case facing said magnetic bodies, detecting change of position of said optical transmitter module case and said optical receiver module case, outputting a signal regarding change of position to said controller.

11. A fiber optic security system as claimed in claim 3, further comprising, an optical transmitter module case, being a hollow cylinder in shape, holding said optical transmitter modules inside, having a plurality of through hole for allowing the optical transmission lines connected respectively to the optical transmitter modules;

an optical receiver module case, being a hollow cylinder in shape, holding said optical receiver modules inside, having a plurality of through hole for allowing the optical transmission lines connected respectively to the optical receiver modules;

a couple of magnetic body respectively forming prescribed magnetic fields outside of said optical transmitter module case and said optical receiver module case; and a couple of magnetic sensor respectively placed inside of said optical transmitter module case and said optical receiver module case facing said magnetic bodies, detecting change of position of said optical transmitter module case and said optical receiver module case, outputting a signal regarding change of position to said controller.

12. A fiber optic security system as claimed in claim 4, further comprising, an optical transmitter module case, being a hollow cylinder in shape, holding said optical transmitter modules inside, having a plurality of through hole for allowing the optical transmission lines connected respectively to the optical transmitter modules;

an optical receiver module case, being a hollow cylinder in shape, holding said optical receiver modules inside, having a plurality of through hole for allowing the optical transmission lines connected respectively to the optical receiver modules;

a couple of magnetic body respectively forming prescribed magnetic fields outside of said optical transmitter module case and said optical receiver module case; and a couple of magnetic sensor respectively placed inside of said optical transmitter module case and said optical receiver module case facing said magnetic bodies, detecting change of position of said optical transmitter module case and said optical receiver module case, outputting a signal regarding change of position to said controller.

13. A fiber optic security system as claimed in claim 2, wherein said optical transmission line is selected from the group consisting of a plastic optical fiber, an optical waveguide, and air.

14. A fiber optic security system as claimed in claim 3, wherein said optical transmission line is selected from the group consisting of a plastic optical fiber, an optical waveguide, and air.

15. A fiber optic security system as claimed in claim 4, wherein said optical transmission line is selected from the group consisting of a plastic optical fiber, an optical waveguide, and air.

* * * * *